US005320556A

United States Patent [19]

Otaka et al.

[11] Patent Number: 5,320,556

[45] Date of Patent: Jun. 14, 1994

[54] ELECTRICAL CONNECTOR WITH FITTING CONFIRMATION MECHANISM

[75] Inventors: Kazuto Otaka; Masakuni Samejima, both of Shizuoka, Japan

[73] Assignee: Yazaki Corporation, Tokyo, Japan

[21] Appl. No.: 12,772

[22] Filed: Feb. 3, 1993

[30] Foreign Application Priority Data

Feb. 21, 1992 [JP] Japan ..... 4-34901

[51] Int. Cl.[5] ..... H01R 13/62

[52] U.S. Cl. ..... 439/372; 439/489

[58] Field of Search ..... 439/345, 350, 354, 357, 439/372, 488, 489

[56] References Cited

U.S. PATENT DOCUMENTS 4,871,325 10/1989 Maejima et al. .
4,873,614 10/1989 Lichtensperger ..... 439/372 X
4,884,978 12/1989 Inaba et al. .
4,941,839 7/1990 Nagasaka et al. .
5,021,003 6/1991 Ohtaka et al. .
5,035,644 7/1991 Nakazato et al. .
5,174,785 12/1992 Endo et al. ..... 439/372 X

FOREIGN PATENT DOCUMENTS 0013489 12/1979 European Pat. Off. .
0484951 11/1991 European Pat. Off. .
60-220581 11/1985 Japan .
1-137572 5/1989 Japan .
2-50981 4/1990 Japan .
2050077 3/1980 United Kingdom .

*Primary Examiner*—Khiem Nguyen
*Attorney, Agent, or Firm*—Sughrue, Mion, Zinn, Macpeak & Seas

[57] ABSTRACT

An object of the present invention is to provide a connector with a fitting confirmation mechanism having a completely fitting detection lock lever which is easily pivotally mounted on the connector. According to the present invention, an electrical connector comprises a pair of connector housings fitted from each other, one connector has a lock lever for detecting a completely engagement of the other connector, flexible engagement plate portions provided at both end portions of a bearing portion of the lock lever, the flexible engagement plate portions having an engagement guide surface and an engagement hole, support bosses which are confronted with each other projected from the other connector, and the bosses engaged with the engagement holes by abutting the engagement guide surface against the bosses.

3 Claims, 4 Drawing Sheets

ELECTRICAL CONNECTOR WITH FITTING CONFIRMATION MECHANISM

BACKGROUND OF THE INVENTION

This invention relates to electrical connector which has a fitting confirmation mechanism and is for connecting electric wires of a motor vehicle or the like to each other.

FIGS. 9 and 10 show a conventional connector including a female connector a and a mail connector b. Metal terminals are housed in the female and the male connectors, respectively, so as to be connected to each other when the female and the male connectors are connected.

The female terminal a has a locking plated extending from a hinge portion c which allows opening and closing of the locking plate d. A fitting confirmation projection e is provided on an inner side of the locking plate d and an engagement projection f is formed on a free end of the locking plate d so that the engagement projection f is engaged with an engagement portion g of the female connector a when the locking plate d is closed.

A through hole h for detecting the complete fitting of the fitting confirmation projection e is formed in a tubular main portion $a_1$ of the female connector a and a surface of the mail connector b is provided with a locking hole i which is coincident with the through hole h.

Therefore, when the female and male connectors are in the incompletely engagement, the locking hole 1 is not coincident with the through hole h. As a result, it is impossible to insert the fitting confirmation projection e into the locking hole i so as not to close the locking plate d. On the hand, when the female and mail connectors are in the completely engagement, the fitting confirmation projection e can be introduced into the through hole h so that operator can confirm the complete engagement of the female and male connectors to lock the connectors to each other.

However, in the conventional connector, the hinge portion may be easily broken, and once the hinge portion is broken, the connector could not be used again.

SUMMARY OF THE INVENTION

The present invention is to solve the above mentioned problem. It is an object of the present invention to provide a electrical connector which has a lock plate is separately provided from the connector so that the locking plate is easily inserted into the connector.

According to an aspect of the present invention, a connector comprises: a mail connector and a female connector engaged with each other; and fitting confirmation device including: lock lever disposed on one connecter, said lock lever for detecting a completely engagement of the other connector; flexible engagement plates formed both side of a bearing portion of the lock lever with slit being formed on the bearing portion in axial direction of the bearing portion so as to divide the flexible engagement plate from the bearing portion, the flexible engagement plates having a hole, respectively; and a pair of mounted bosses provided on one connector, the bosses being confronted with each other, the bosses being respectively engaged with the hole.

According to the present invention, the elastic engagement plate portions which are provided on both end portions of the bearing portion of the locking lever are displaced in accordance with slits to engage the engagement hole into the support boss.

DETAILED DESCRIPTION OF THE PREFERRED EMBODIMENTS

Preferred embodiments of the present invention will now be described with references to the accompany drawings.

Figure 1:
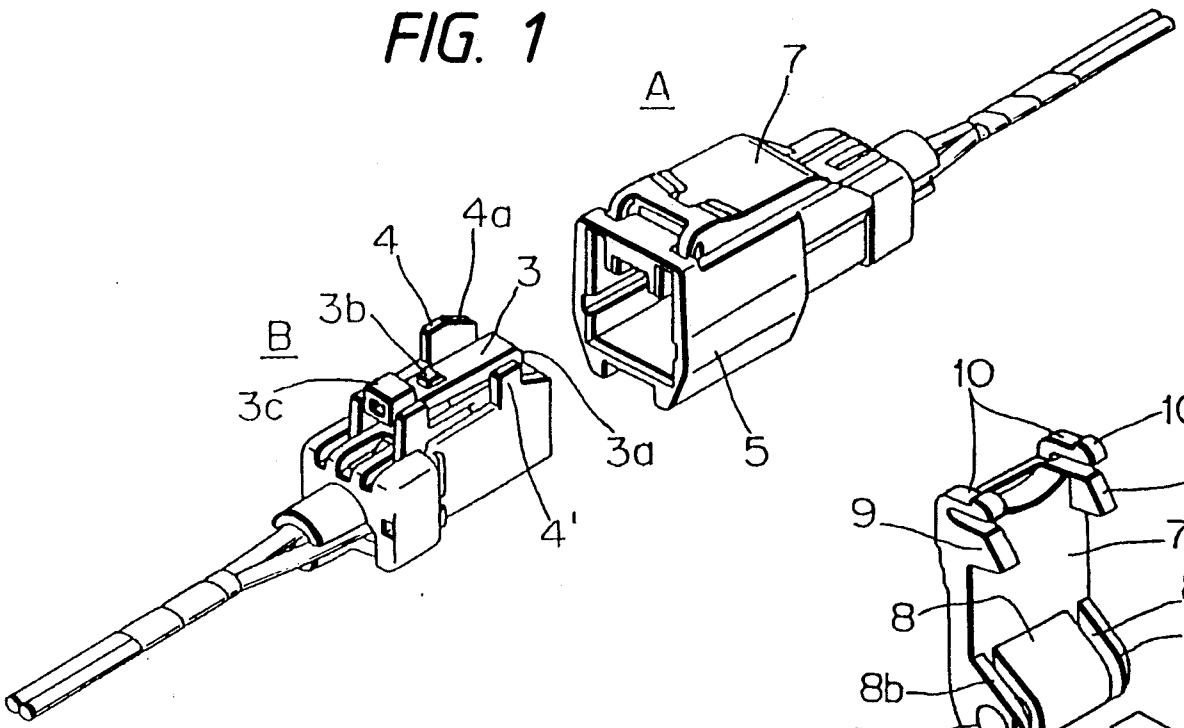
FIG. 1 is a showing a perspective view of an electrical connectors of one embodiment of the present invention.
Figure 2:
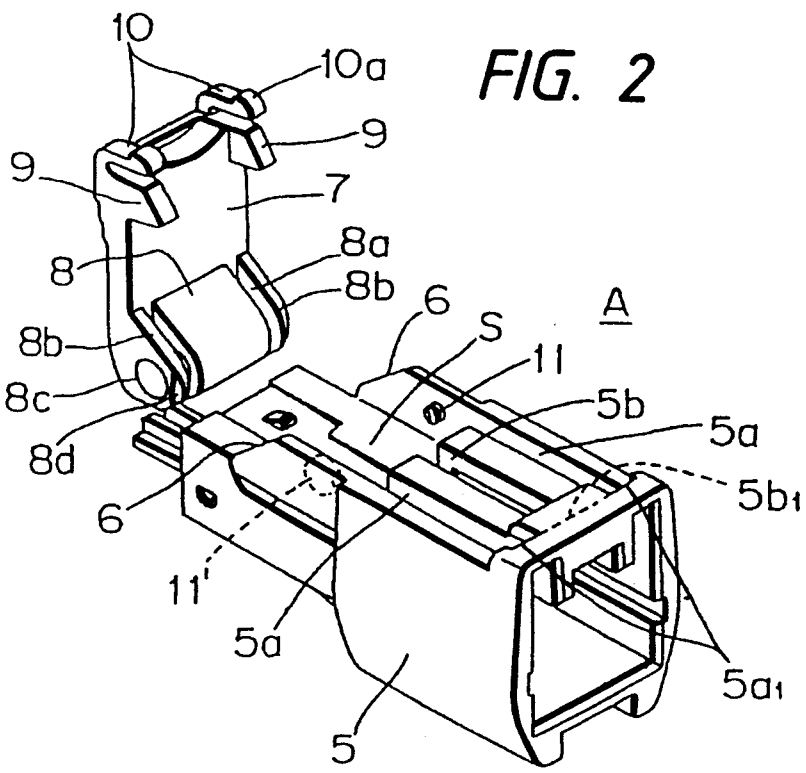
FIG. 2 is a showing an exploded perspective view of one of the electrical connectors shown in FIG. 1.

As shown in FIG. 1, A designates a female connector and B designates a male connector. Both connectors are made of synthetic resin. A male terminal 1 is housed and engaged into the female connector. A female terminal 2 is housed and engaged into the male connector B. The male and female terminals are completely connected when the mail and the female connectors are completely engaged as shown in FIG. 3.

Figure 3:
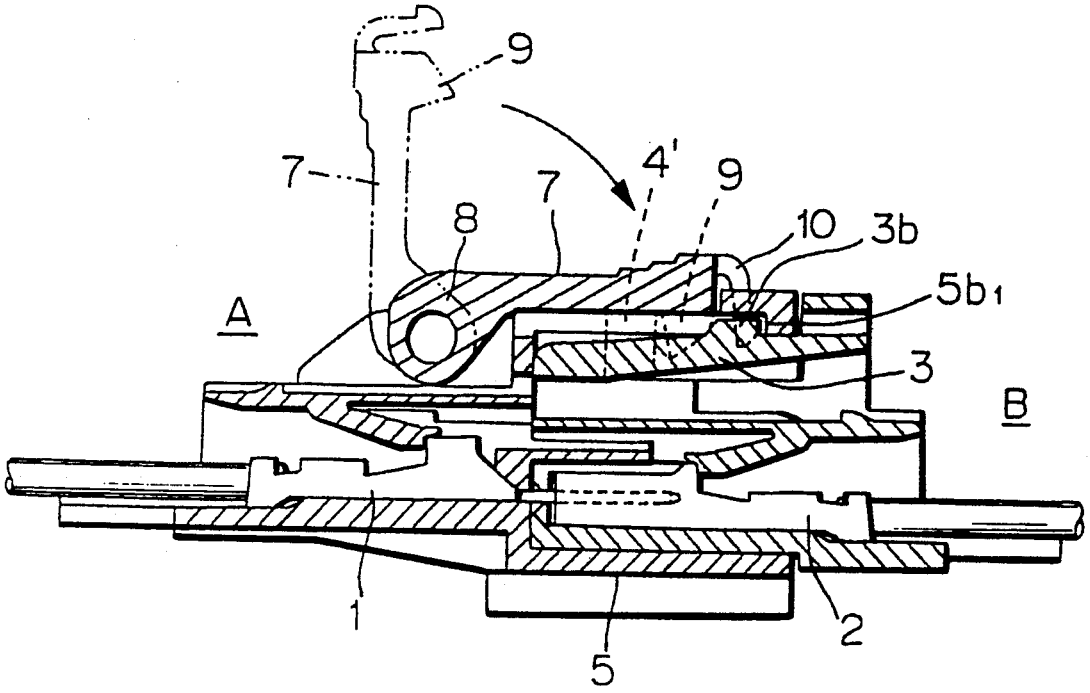
FIG. 3 is a sectional view of the electrical connectors which are completely fitted to each other.

As shown in FIG. 3, a flexible engagement arm 3 is extendingly provided on an upper surface of the male connector B through a rising base portion 3*a* at the front end thereof. An engagement projection 3*b* is disposed on a middle portion of the flexible engagement arm 3 and a push operating portion 3*c* is formed on the other end portion opposite to the rising based portion 3*a*. Moreover, fitting confirmation projections 4 and 4' extend up from a front portion of the male connector B at both end of the flexible engagement arm 3. One of fitting confirmation projections 4 and 4' has a lock release tapered portion 4*a* at an upper end thereof.

A tubular portion 5 for housing the female connector B is provided at a front portion of the male connector A. Slits 5*a* and 5*b* extending in the connector inserting direction are provided at both end portions and a middle portion of the upper surface of the tubular portion 5. Moreover, engagement portions $5a_1$, $5b_1$ are provided on front end portion of the slits 5*a* and 5*b*, respectively. A pair of support plate portions 6 are provided at back end portion of the tubular portion 5 to serve a lock lever housing recess portion S for mounting the lock lever 7.

A bearing portion 8 expanded from an end portion of the lock lever 7 is provided with flexible engagement plates 8*b* at both side proximal portions thereof, respectively, in such a manner that the slits 8*a* divide the flexible engagement plates 8*b* from the bearing portion. Engagement hole 8*c* is formed at the center of the flexible engagement plates 8b. Engagement guide surfaces 8d are formed on the flexible engagement plates 8b, respectively.

Fitting confirmation projections 9 corresponding to the slits 5a extend from a distal portion of the locking lever 7. The flexible engagement arms 10 are respectively provided with engagement tip portions 10a projecting from distal portions of the flexible engagement arms 10.

Support bosses 11 and 11' project from inner sides of a pair of the support plate portions 6, respectively, and confront from each other in the direction orthogonal to inserting direction of the male terminal B. When the bearing portion 8 of the lock lever 7 is abutted against the support bosses 11 and 11', the flexible engagement plates 8b intrude into the locking lever housing recess portion S through the engagement guide surfaces 8d with the flexible engagement plates 8b being inwardly bent in accordance with the slit 8a. Succeedingly, the engagement hole 8c is engaged with the support bosses 11 and 11' so as to return the flexible engagement plates 8b to the original position thereof. As a result, it is easily possible to pivotally mount the lock lever 7.

As shown in FIG. 1, when the lock lever 7 is closed, the fitting confirmation projections 9 are inserted into the slits 5a and the engagement tip portions 10a of flexible engagement arm 10 are engaged with the engagement portions $5a_1$. Therefore, the closure condition is kept.

In this condition, when the female connector B is fitted into the male connector A, the fitting confirmation projection 4 and 4' are inserted through the lock release tapered portion 4a to disconnect the engagement tip portions 10a from the engagement portions $5a_1$ and to push up the flexible engagement arm 10 and/or the lock lever 7 so that the engagement projection 3b of the flexible engagement arm 3 is engaged with the engagement portion $5b_1$ to lock the engagement of the male and female connectors in the complete fitting position. As a result, in this condition, the fitting confirmation projections 9 of the lock lever 7 could be inserted into the slits 5a so as to maintain the closure condition by the flexible engagement arm 10, as shown in FIG. 3.

Figure 4:
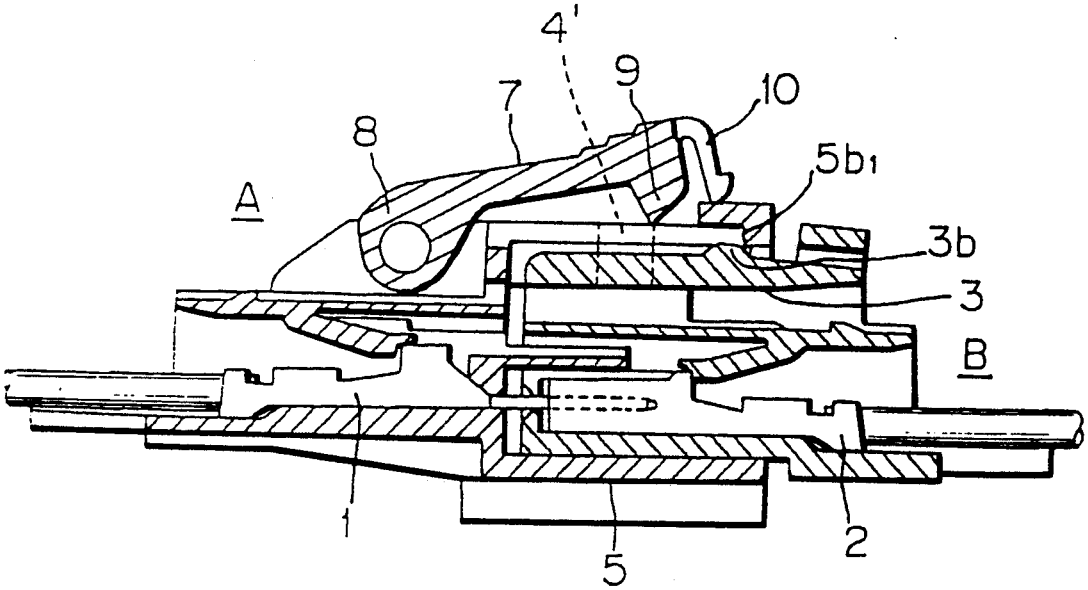
FIG. 4 is a sectional view of the electrical connectors which are incompletely fitted to each other.

As shown in FIG. 4, in the case where the engagement between the female and male connectors A and B is not locked by the flexible engagement arm 3 due to the female and male connectors A and B being incompletely engaged, when the lock lever is closed, the fitting confirmation projections 9 abut against the fitting confirmation projection 4 and 4' so as to detect the incomplete engagement.

Figure 5:
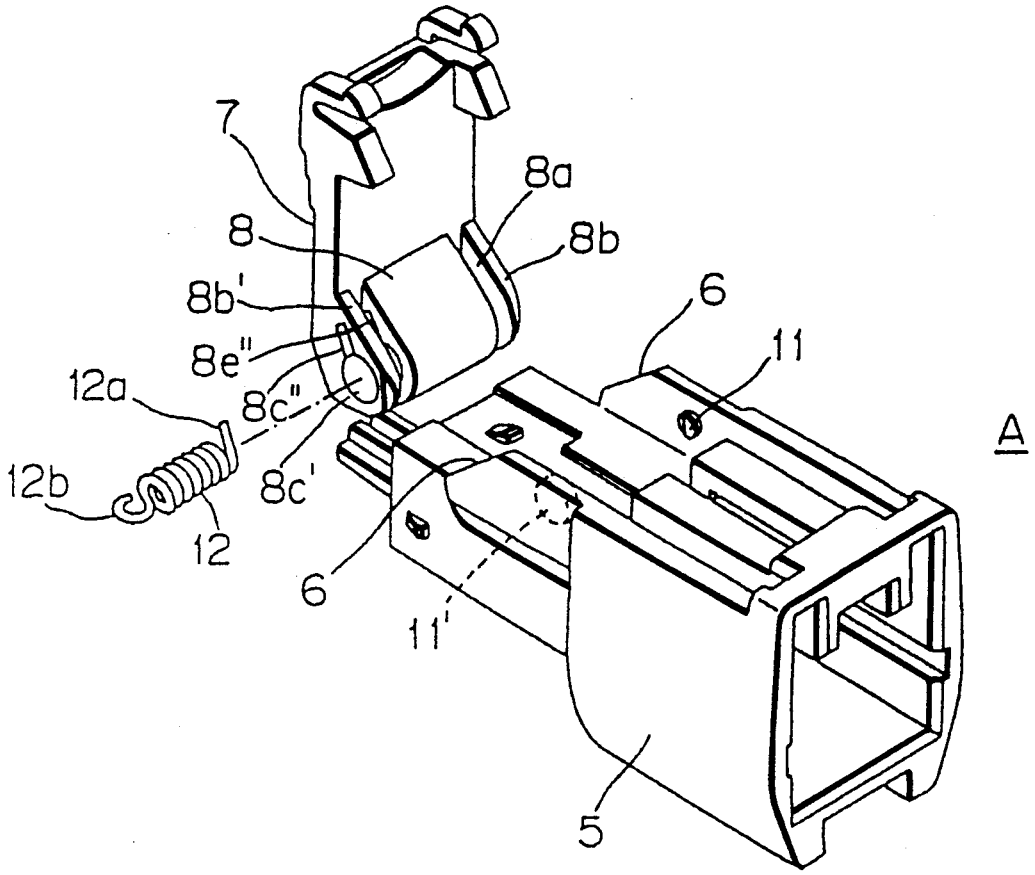
FIG. 5 is an exploded perspective view of an electrical connectors of another embodiment of the present invention.

In another embodiment of the present invention as shown in FIG. 5, a coil spring 12 for automatically rotating the locking lever 7 is upwardly mounted in bearing portion 8 of the lock lever 7 when the lock lever 7 is released from the tubular portion 5.

Figure 6:
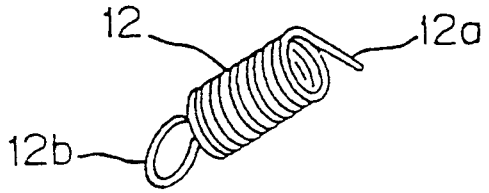
FIG. 6 is a perspective view of a coil spring of another embodiment of the present invention.
Figure 7:
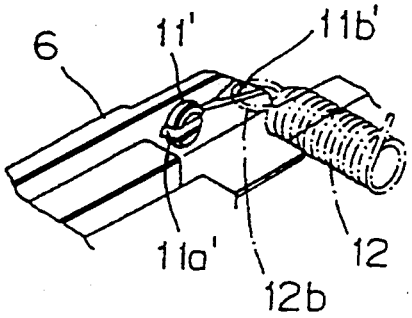
FIG. 7 is a perspective view of support bosses of another embodiment of the present invention.
Figure 9:
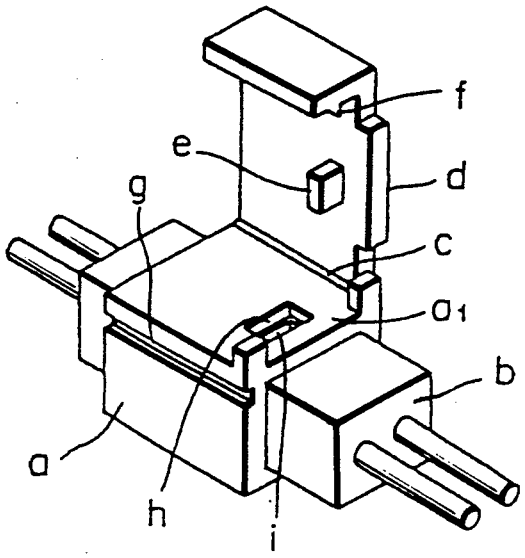
FIG. 9 is a perspective view of a conventional electrical connectors.

Namely, as shown in FIG. 6, a suspended projection 12a extending in a circumferential direction is provided on one end of the coil spring 12 and an engagement ring portion 12b is windingly provided on the other end of the coil spring in axial direction. The bearing portion 8 of the lock lever 7 has a spring accommodating chamber 8e' corresponding in diameter to a large engagement hole 8c' of the flexible engagement plate 8b', and accommodating recesses 8c'' and 8e'' are formed on the large engagement hole 8c' and the spring accommodating chamber 8e', respectively, in axial direction. The support plate portion 6 confronted with the flexible engagement plate 8b' is provided with a large support boss 11' with the engagement recess 11a', and the support plate 6 has an entrance slit 11b' communicated with the engagement recess 11a'.

Figure 8:
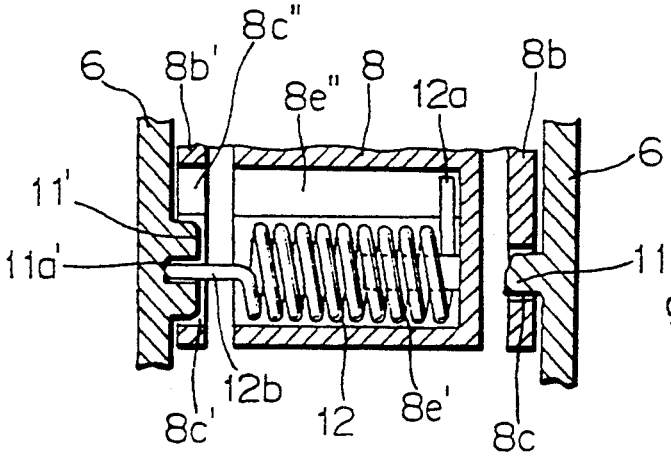
FIG. 8 is a sectional view of the bearing portion of another embodiment of the present invention.
Figure 10:
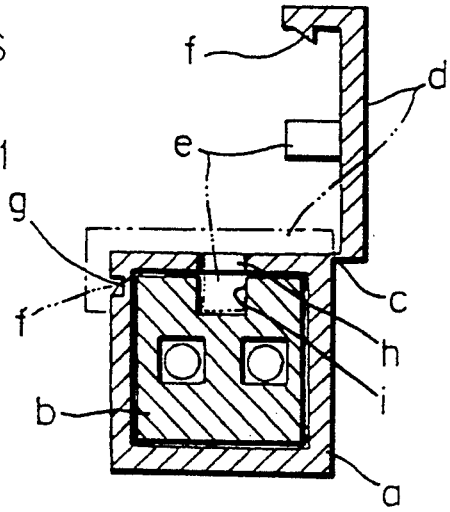
FIG. 10 is a sectional view of the conventional electrical connectors.

In this structure, the coil spring 12 is inserted from the large engagement hole 8c' into the spring accommodating chamber 8e' with the suspended portion 12a being engaged with the accommodating recesses 8c'' and 8e''. After that, the coil spring 12 is mounted to the lock lever 7 with the suspended portion 12a being slightly projected from the flexible engagement plate 8b'. In this condition, the engagement ring portion 12b is pushed to engage the engagement projection portion 12b with the entrance slit 11b' so as to engage the support bosses 11 and 11' with the flexible engagement holes 8b and 8b'. At this time, the engagement projection portion 12b of the coil spring 12 is inserted into the engagement recess 11a', as shown in FIG. 8.

As a result, the lock lever is closed from this condition so that the coil spring is twisted to store an elastic restoring force.

According to the present invention, one of connectors which are fitted with each other has the lock lever for detecting the completely engagement of the other connector. Both ends of the bearing portion of the lock lever provide with the support plate portions by the slits, and the engagement holes are formed into the support plate portions so that the engagement holes are engaged with a pair of the support bosses confronted from each other. Therefore, the breakage of the lock lever is seldom occurred and if the lock lever is broken, it is easy to install a new lock lever. Moreover, the lock lever is simply mounted with the support bosses.

On the other hand, according to the present invention, the spring for urging the lock lever toward the direction of swinging up thereof is mounted into the bearing portion of the lock lever and the engagement projection portion is formed at one end of the coil spring to be engaged with the engagement recess of the support boss, and the engagement recess has the entrance slit communicated therewith so that the engagement projection portion is engaged from the entrance slit to the engagement recess. Therefore, the return coil spring is easily mounted on the bearing portion.

What is claimed is:

1. An electrical connector comprising:

a male connector and a female connector engageable with each other;

a fitting confirmation means for confirming that said male and female connectors have been completely connected to each other, said confirmation means including:

a lock lever pivotably disposed on one of said connectors for detecting a complete engagement of the connectors with each other, said lock lever including a bearing portion about which said lever pivots and flexible engagement plates formed on both sides of said bearing portion with gaps formed between said bearing portion and said flexible engagement plates, respectively, so as to separate said flexible engagement plates from said bearing portion, each of said flexible engagement plates having a hole therein; and a pair of mounted bosses provided on said one connector, said bosses confronting each other and being respectively engaged with said hole to pivotally secure said lock lever to said one connector; and a coil spring for urging said lock lever to pivot in a predetermined direction, said coil spring being disposed at least partially in said bearing portion and having an engagement ring portion at one end thereof, wherein one of said bosses includes means for retaining said engagement ring portion.

2. An electrical connector as claimed in claim 1, wherein said retaining means includes a retaining slit provided in said one boss in which said engagement ring portion is received and wherein one of said engagement plates associated with said one boss has an entrance slit communicating with said retaining slit, said engagement ring portion sliding in said entrance slit to said retaining slit upon insertion of said lock lever.

3. An electrical connector as claimed in claim 1, wherein said lock lever is detachably engaged with said one connector.

* * * * *